US007040521B2

(12) United States Patent
Kolodziej et al.

(10) Patent No.: US 7,040,521 B2
(45) Date of Patent: May 9, 2006

(54) GAS DRIVEN ACTUATION FEED TUBE FOR COMBUSTION POWERED FASTENER-DRIVING TOOL

(75) Inventors: Norbert K. Kolodziej, Park Ridge, IL (US); Cheryl L. Panasik, Elburn, IL (US); Kevin M. Tucker, Chicago, IL (US); James W. Robinson, Mundelein, IL (US); Yongping Gong, Glenview, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 10/945,412

(22) Filed: Sep. 20, 2004

(65) Prior Publication Data

US 2006/0043143 A1 Mar. 2, 2006

Related U.S. Application Data

(60) Provisional application No. 60/606,305, filed on Sep. 1, 2004.

(51) Int. Cl.
*B25C 1/08* (2006.01)

(52) U.S. Cl. ..... 227/10; 227/120; 227/130; 227/138

(58) Field of Classification Search ..... 227/10, 227/120, 138, 136, 130, 8; 123/46 SC
See application file for complete search history.

(56) References Cited

U.S. PATENT DOCUMENTS

| | | | | | |
|---|---|---|---|---|---|
| 4,483,474 | A | * | 11/1984 | Nikolich | 227/8 |
| 5,197,646 | A | * | 3/1993 | Nikolich | 227/8 |
| 5,558,264 | A | | 9/1996 | Weinstein | |
| 5,687,899 | A | * | 11/1997 | Dohi et al. | 227/10 |
| 5,713,313 | A | * | 2/1998 | Berry | 123/46 SC |
| 5,752,643 | A | * | 5/1998 | MacVicar et al. | 227/10 |
| 5,909,836 | A | * | 6/1999 | Shkolnikov et al. | 227/8 |
| 6,102,270 | A | | 8/2000 | Robinson | |
| 6,260,519 | B1 | * | 7/2001 | Phillips | 123/46 R |
| 6,318,615 | B1 | * | 11/2001 | Walter | 227/10 |
| 6,755,335 | B1 | * | 6/2004 | Fielitz | 227/10 |
| 2003/0034377 | A1 | | 2/2003 | Porth et al. | |

* cited by examiner

*Primary Examiner*—Scott A. Smith
(74) *Attorney, Agent, or Firm*—Lisa M. Soltis; Mark W. Croll; Greer, Burns & Crain Ltd.

(57) ABSTRACT

A combustion tool having a gas actuated magazine advance includes a combustion chamber defined in part by a cylinder, a valve sleeve axially reciprocating relative to the cylinder and an upper surface of a piston, a pneumatically actuated magazine fastener mechanism, and an exhaust driven actuation feed tube having a first end configured for insertion into an opening in the cylinder in fluid communication with the combustion chamber and a second end connected to the magazine fastener advance mechanism.

19 Claims, 4 Drawing Sheets

GAS DRIVEN ACTUATION FEED TUBE FOR COMBUSTION POWERED FASTENER-DRIVING TOOL

This application claims the benefit of Provisional Application No. 60/606,305, filed Sep. 1, 2004.

BACKGROUND

The present invention relates generally to fastener-driving tools used to drive fasteners into workpieces, and specifically to combustion-powered fastener-driving tools, also referred to as combustion tools.

Combustion-powered tools are known in the art, and one type of such tools, also known as IMPULSE® brand tools for use in driving fasteners into workpieces, is described in commonly assigned patents to Nikolich U.S. Pat. Re. No. 32,452, and U.S. Pat. Nos. 4,522,162; 4,483,473; 4,483,474; 4,403,722; 5,197,646; 5,263,439 and 6,145,724, all of which are incorporated by reference herein. Similar combustion-powered nail and staple driving tools are available commercially from ITW-Paslode of Vernon Hills, Ill. under the IMPULSE® BUILDEX® and PASLODE® brands.

Such tools incorporate a generally pistol-shaped tool housing enclosing a small internal combustion engine. The engine is powered by a canister of pressurized fuel gas, also called a fuel cell. A battery-powered electronic power distribution unit produces a spark for ignition, and a fan located in a combustion chamber provides for both an efficient combustion within the chamber, while facilitating processes ancillary to the combustion operation of the device. Such ancillary processes include: inserting the fuel into the combustion chamber; mixing the fuel and air within the chamber; and removing, or scavenging, combustion by-products. The engine includes a reciprocating piston with an elongated, rigid driver blade disposed within a single cylinder body.

Upon the pulling of a trigger switch, which causes the spark to ignite a charge of gas in the combustion chamber of the engine, the combined piston and driver blade is forced downward to impact a positioned fastener and drive it into the workpiece. The piston then returns to its original, or pre-firing position, through differential gas pressures within the cylinder. Fasteners are fed magazine-style into the nosepiece, where they are held in a properly positioned orientation for receiving the impact of the driver blade.

Conventional combustion fastener driving tools employ straight magazines holding approximately 30 fasteners each. In some operational applications, particularly commercial construction projects, there is a need for a tool which is capable of driving a greater number of fasteners in a shorter period of time. The use of coil magazines with greater fastener capacities is common in electrically or pneumatically powered fastener driving tools, but for various reasons, such magazines have not become acceptable with combustion tools. Reasons for the undesirability of such high capacity magazines in these tools include the additional weight of the fasteners causing premature operator fatigue, and the additional energy required to operate the coil magazine fastener advance has not proved reliable.

In commonly-assigned U.S. Pat. No. 5,558,264, which is incorporated by reference herein, there is described an apparatus for driving a pneumatically activated magazine, such as a coil magazine, using diverted combusted gases. In the reference a diverter conduit is disposed on the tool with one end affixed in the cylinder wall via a nipple-type fitting, in a location between the upper and lower ends of the cylinder, and also between the uppermost position of the driving piston and the exhaust ports. The tube runs externally of the tool housing and is connected at its opposite end to a pneumatically operated feeding mechanism cylinder. In practice, it has been found that the system of the '264 patent has not met operational objectives. One drawback is the perceived lack of power generated by the exhaust stroke of the power source, which has been incapable of reliably driving the magazine advancing mechanism.

Thus, there is a need for a combustion-powered fastener-driving tool which is capable of operating reliably with high capacity magazines, including but not limited to coil magazines. There is also a need for a combustion-powered fastener-driving tool which is designed for reliably driving a magazine advancing mechanism with gas generated through combustion cycles.

BRIEF SUMMARY

The above-listed needs are met or exceeded by the present exhaust or other combustion generated gas-driven actuation feed tube for a combustion-powered fastener-driving tool. To increase power to the magazine advance, an end of the tube is connected to the cylinder to be in fluid communication with the combustion chamber. As such, more combustion power is available for driving the magazine advance. The present tube is connected to the tool without special fittings, which are suspected of reducing gas flow. Further, the tube is located internally of the tool to avoid damage during normal operation or rough handling.

More specifically, a combustion tool having a gas actuated magazine advance includes a combustion chamber defined in part by a cylinder, a valve sleeve axially reciprocating relative to the cylinder and an upper surface of a piston, as well as a pneumatically actuated magazine drive mechanism. An exhaust driven actuation feed tube has a first end configured for insertion into an opening in the cylinder in fluid communication with the combustion chamber and a second end connected to the magazine drive mechanism.

In another embodiment, an exhaust driven actuation tube is configured for use in a combustion tool with a combustion chamber defined in part by a cylinder and a valve sleeve axially reciprocating relative to the cylinder, the combustion tool also provided with a pneumatically actuated drive cylinder for a magazine advance. The tube includes a first end being angled relative to a longitudinal axis and configured for insertion into an opening in the cylinder in fluid communication with the combustion chamber, a sleeve portion axially adjacent the first end and configured for disposition between an exterior of the cylinder and an interior of the valve sleeve so that the valve sleeve freely reciprocates relative to the cylinder, an exhaust portion axially adjacent the sleeve portion and forming a general "C" shape around an exhaust valve of the tool, and an actuation portion axially adjacent the exhaust portion and configured for fluid communication with a magazine drive cylinder.

DETAILED DESCRIPTION

Figure 1:
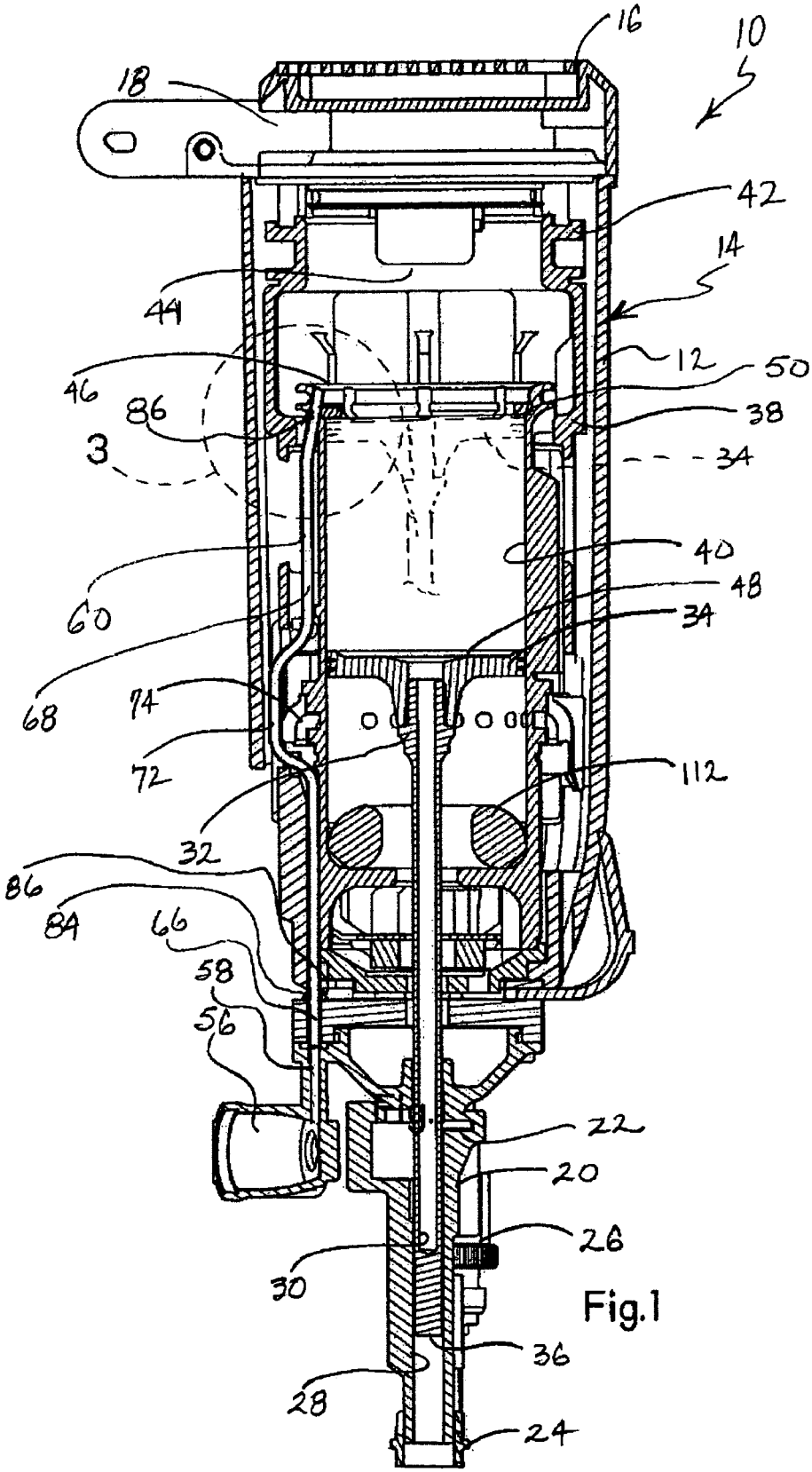
FIG. 1 is a fragmentary front vertical section of a combustion-powered fastener-driving tool suitable for incorporating the present exhaust driven actuation feed tube.

Referring now to FIG. 1, a combustion-powered fastener-driving tool suitable for use with the present exhaust driven actuation feed tube is generally designated 10 and preferably incorporates the teachings of the patents referred to above and incorporated by reference herein. However, the present system is considered suitable for many types of combustion-powered fastener-driving tools having a variety of configurations. A main housing 12 is typically provided in two clamshell-type halves and encloses a combustion power source, generally designated 14. At an upper end 16 of the tool 10, the power source 14 is provided with a cylinder head 18 supporting a spark plug and preferably a fan 19 (FIG. 5) as is known in the art.

Opposite the upper end 16, a lower end 20 includes a nosepiece 22 secured to the power source 14 and having a workpiece contact element 24 axially reciprocating relative thereto. The workpiece contact element 24 includes a fastener depth adjuster 26. Various embodiments of such adjusters are known in the art and the arrangement depicted here is not considered critical to the present tool 10. A driver blade passageway 28 in the nosepiece 22 slidingly accommodates a driver blade 30 secured at an upper end 32 to a piston 34. The driver blade 30 is shown partially hollow, but solid driver blades are also contemplated. A lower end 36 of the driver blade 30 is configured for engaging fasteners (not shown) fed into the nosepiece 22 through a magazine (not shown) and driving them into a workpiece as is well known in the art.

Connected to the workpiece contact element 24 is a linkage (not shown) for transmitting axial sliding motion of the element to a valve sleeve 38 which surrounds a cylinder 40 fixed in the tool 10. Prior to combustion and the driving of a fastener, depression of the tool 10 against the workpiece causes the workpiece contact element 24 to move axially relative to the nosepiece 22 against a biasing force. Upward movement of the linkage causes an upper end 42 of the valve sleeve 38 to engage the cylinder head 18 and close a combustion chamber 44. The combustion chamber 44 is defined at a lower end by an upper end portion 46 of the cylinder 40 and an upper surface 48 of the piston 34 when the piston is in a pre-firing position (shown in phantom and fragmentarily in FIG. 3, also shown in prior art version in FIG. 5).

Figure 3:
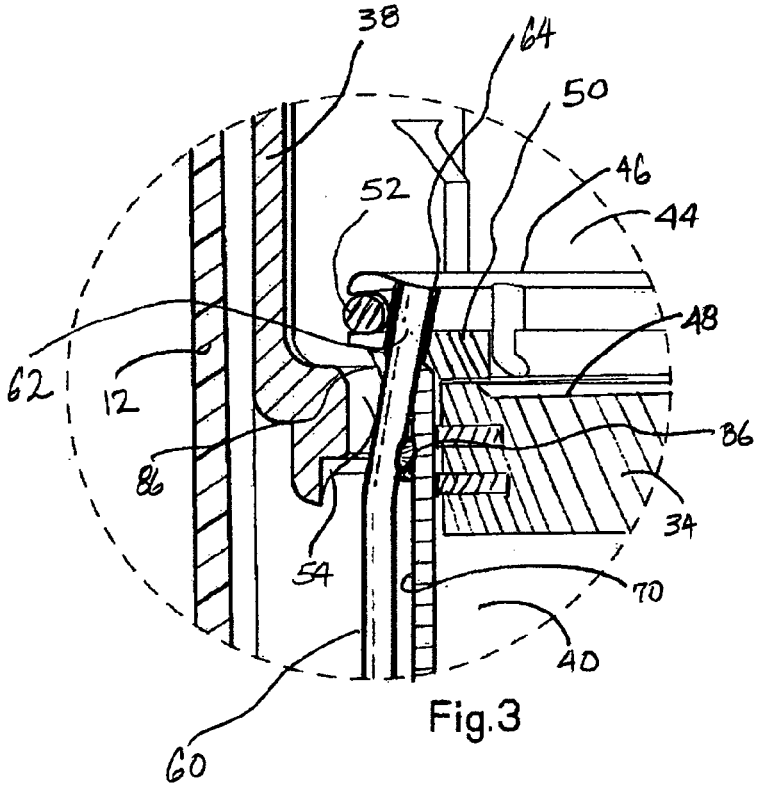
FIG. 3 is an enlarged fragmentary section of the tool shown in FIG. 1.

Referring now to FIGS. 1 and 3, an annular stop 50 limits upward travel of the piston 34. Also, an O-ring 52 or similar annular seal slidingly accommodates the sliding action of the valve sleeve 38 relative to the cylinder 40 and engages a lower interior rim 54 of the valve sleeve when the combustion chamber 44 is closed through depression of the tool 10 against a workpiece. The combustion chamber 44 is thus defined by the cylinder head 18, the valve sleeve 38, the upper end portion 46 of the cylinder 40 and the upper surface 48 of the piston 34.

Referring again to FIG. 1, it is contemplated that the present tool 10 is provided with a magazine (not shown) powered by a magazine fastener advance mechanism similar to that described in U.S. Pat. No. 5,558,264. Such a magazine fastener advance is pneumatically powered, using a fastener feed advance cylinder 56 which, in the present application is contemplated as representative of the magazine fastener advance mechanism. The cylinder 56 is preferably connected to the nosepiece 22 and is in fluid communication with an internal passageway 58. As is known in the art, a piston (not shown) in the cylinder 56 is biased by a spring (not shown) to a first position in the cylinder. The piston is connected to a toggle linkage (not shown) associated with the magazine. Pneumatic force acting on the piston in the cylinder 56 sufficient to overcome the biasing action of the spring, and moving the piston to a second position will cause actuation of the toggle linkage and result in the delivery of a fastener into the nosepiece 22 for driving.

Figure 2:
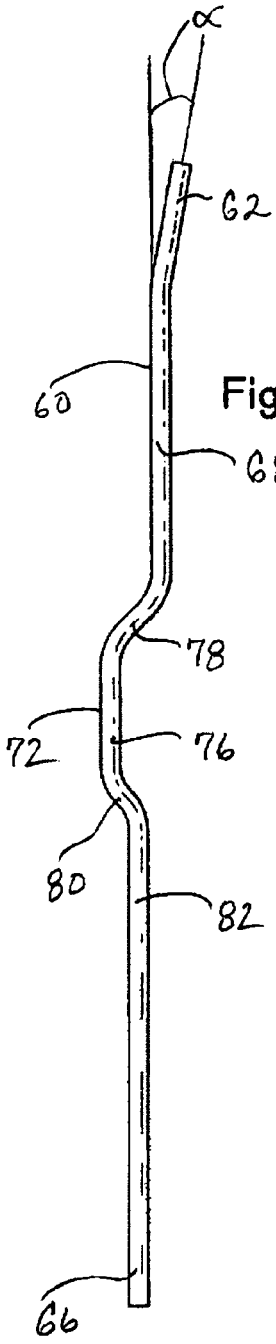
FIG. 2 is a front elevation of the present fragmentary vertical section of the present exhaust driven actuation feed tube.

Referring now to FIGS. 1–3 a feature of the present tool 10 is a gas driven actuation feed tube 60 which transmits combustion generated gas, preferably exhaust gas, from the combustion chamber 44 to the magazine fastener advance cylinder 56 for initiating the advance of a fastener into the nosepiece 22 to be ready for the next combustion cycle. Advantages of the tube 60 over prior art configurations include that the tube 60 is located within the housing 12 and is not prone to damage or disconnection as is the case with the tube disclosed in U.S. Pat. No. 5,558,264. Another advantage is that there are no specific nipple fittings, threaded connectors or elbow fittings needed to connect the tube 60 to the tool 10. Still another advantage of the present tubes 60 is that it is securable to respective connection points without the use of tools. Yet another advantage is that placing the gas feed tube 60 in, or at least in fluid communication with, the combustion chamber 44 or at the bottom of the cylinder 40 (FIG. 4) where the travel of the piston 34 terminates allows a repeatable, reliable fastener feed system. While other materials are contemplated, the tube 60 is made of stainless steel, specifically 11 gauge 304 stainless steel, however other equivalent durable heat resistant materials are contemplated.

More specifically, and referring now to FIG. 2, the tube 60 has a first end 62 configured for insertion into an opening 64 (best seen in FIG. 3) in the upper end 46 of the cylinder 40 in fluid communication with the combustion chamber 44, and a second end 66 connected to the magazine drive mechanism, specifically the cylinder 56. The first end 62 of the tube 60 is angled relative to a longitudinal tube axis at an angle $\alpha$. In the preferred embodiment, the amount of angled deflection is approximately 10° relative to the longitudinal tube axis to facilitate normal tool action, however other amounts of angular deflection are contemplated.

Referring now to FIG. 3, the angle $\alpha$ is provided so that the end 62 can be inserted into the opening 64 inside the sealing O-ring 52 and above the upper surface 48 of the piston 34. At the same time, due to the internal placement of the tube 60 within the tool 10, the valve sleeve 38 is still slidable relative to the cylinder 40 with the tube in place.

Referring again to FIG. 2, the tube 60 also includes a sleeve portion 68 axially adjacent the first end 62 and configured for disposition between an exterior 70 (FIG. 3) of the cylinder 40 and the lower interior rim 54 of the valve sleeve 38 so that the valve sleeve freely reciprocates relative to the cylinder. The sleeve portion 68 generally follows or defines the longitudinal axis of the tube 60. Connected to the sleeve portion 68 is an exhaust portion 72 axially adjacent the sleeve portion 68 and forming a general "C" shape made of four elbow portions around an exhaust valve assembly 74 of the tool (FIG. 1). It is contemplated that the specific configuration of the exhaust portion 72 is not restrictive and can assume any shape which is offset from the longitudinal axis of the tube 60 and provides clearance around the exhaust valve assembly 74. As is known in such tools, the exhaust valve assembly 74 is disposed in the cylinder 40 and allows one-way flow of gas from inside to outside the cylinder.

Included in the exhaust portion 72 is a main segment 76 generally parallel with said sleeve portion and having two ends, 78 and 80. Each of the ends 78, 80 is radiused for providing a transition to the respective sleeve portion 68, in the case of the end 78 and an actuation portion 82 in the case of the end 80. The radiused configuration of the ends 78, 80 reduces the potential for gas flow-inhibiting kinks and promotes free gas flow, which enhances the performance of the fastener feed advance cylinder 56. In addition, the radiused ends 78, 80 facilitate the retention of the tube 60 within the tool 10 without the use of tools or other connection fittings.

The actuation portion 82 is axially adjacent the exhaust portion 72 and is configured for fluid communication with the fastener feed advance cylinder 56. In addition, the actuation portion 82 ends with the second end 66 of the tube 60, and as such is the connection point with the fastener advance cylinder 56. As best seen in FIG. 1, with the exception of a small segment 84 of the actuation portion 82, the entire tube 60 is located within the tool 10.

While acceptable results have been obtained by inserting the first end 62 into the opening 64 and placing the second end 66 into the passageway 58, improved results have been achieved by placing chemical adhesive 86, including suitable heat resistant sealants, and adhesives or combinations of such qualities, at the junction of each of the ends 62, 66 and the associated receptacle 64, 58. A particularly suitable chemical adhesive 86 with sealing qualities is Loctite® adhesive, manufactured by Henkel Corporation, Rocky Hill Conn.

The tube 60 was placed in tools 10 having varying displacements and still provided sufficient gas force for reliably driving the fastener feed advance cylinder 56. A first tool having an engine size of 19.5 $in^3$ had a tube 60 with an inner diameter in the approximate range of 0.077–0.100 inch and a length of approximately 11.18 inches. This tube was relatively straight, and lacked the elbow bends of the exhaust portion 72. A second tool had an engine size of 16.8 $in^3$, a tube 60 with an inner diameter in the approximate range of 0.077–0.100 inch and a length of 11.063 inches, as well as four elbow bends. A third tool had an engine size of 7.9 $in^3$, a tube inner diameter in the approximate range of 0.100–0.160 inch and a length of 10.5 inches. As was the case with the first tool, the third tool was relatively straight. Applying the formula for finding the volume of a cylinder as $v=Ir^2h$ for the above values to determine tube volume, and comparing same against engine displacement, favorable results were found when the tube volume was between approximately 0.25% and 1.05% of engine displacement. Thus, it will be seen that the present tube 60 can be provided to tools of varying displacements and still provide reliable magazine advancement results.

Figure 4:
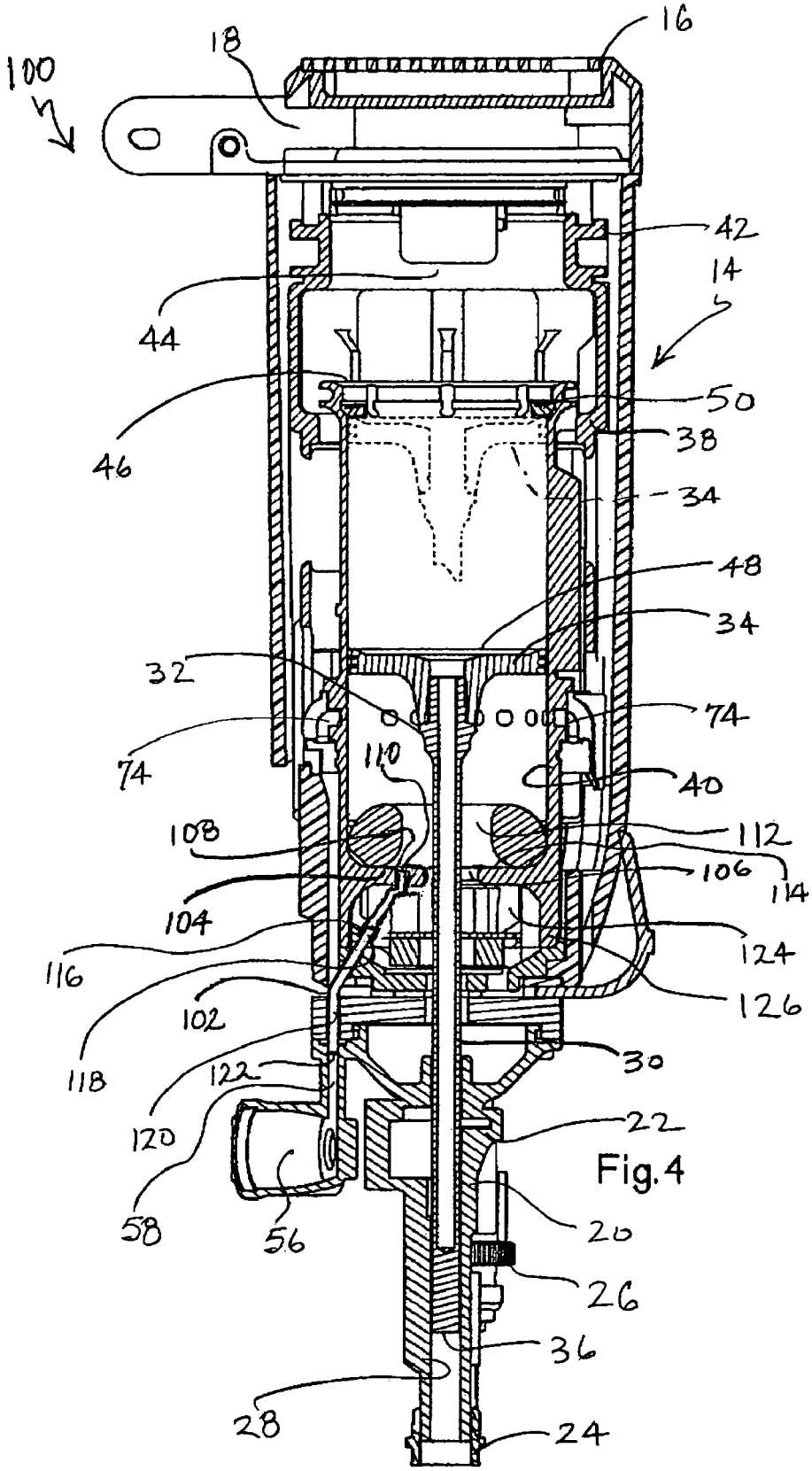
FIG. 4 is a fragmentary front vertical section of a combustion-powered fastener-driving tool suitable for incorporating an alternate embodiment gas feed tube for driving a fastener advance.

Referring now to FIG. 4, an alternate embodiment of the combustion-powered fastener-driving tool of FIG. 1 is shown and generally designated 100. The tool 100 shares many components with the tool 10, which have been designated with the same reference numbers. The above-discussed operation of the tool 10 is generally applicable to the tool 100. A principal distinction of the tool 100 is that the exhaust driven actuation feed tube 60 has been replaced with a gas feed tube 102 located at a lower end of the cylinder 40 at an annular ledge 104. The ledge 104 defines an axial opening 106 through which the driver blade 30 reciprocates. A gas feed tube port 108 is also defined in the ledge 104 and is dimensioned to frictionally accommodate an upper end 110 of the feed tube 102. As is the case with the tube 60, chemical adhesive or sealant may be applied to more securely retain the end 110 in place.

This location of the upper end 110 in the gas tube port 108 places the tube 102 in fluid communication with the cylinder 40. While a piston return bumper 112 is located, as it typical in such tools, on an upper surface 114 of the annular ledge 104, it is contemplated that sufficient clearance exists between the bumper 112 and the cylinder 40 so that a gas front forced by the piston 34 after combustion will be of sufficient volume and pressure to enter the tube 102 and operate the fastener feed advance cylinder 56. The presence of the exhaust valves 74 is not considered a drawback to the generation of sufficient gas force. Thus, while the cylinder 56 of the tool 10 is directly actuated by exhaust gas, the tube 102 of the tool 100 is indirectly actuated by exhaust gas, since the exhaust gas is a function of the creation of the force pushing the piston 36 down the cylinder 40, which creates the force for driving the cylinder 56. It is also contemplated that the upper end 110 may be located in other areas of the lower end of the cylinder 40 and still achieve sufficient gas pressure and volume for powering the cylinder 56.

An opposite end 116 of the gas feed tube 102 is fixed to a nipple 118 of a tube segment 120 located internally of the tool 100 and in fluid communication with the internal passageway 58. The connection at this point is similar to that of the second end 66 of the tube 60, with an end 122 lodged in the passageway 58. Between the nipple 118 and the end 110, the feed tube 102 passes through an inner cavity 124 of the tool 100 defined by a lower lip 126 of the cylinder 40. While it is preferred that the tube 102 is made of flexible plastic tubing and the segment 120 is relatively rigid and made of metal, it is also contemplated that the portions 102, 120 may be unitary and made of the same material, either flexible or rigid tubing, with appropriate bending provided for proper location and connection of the tube.

Figure 5:
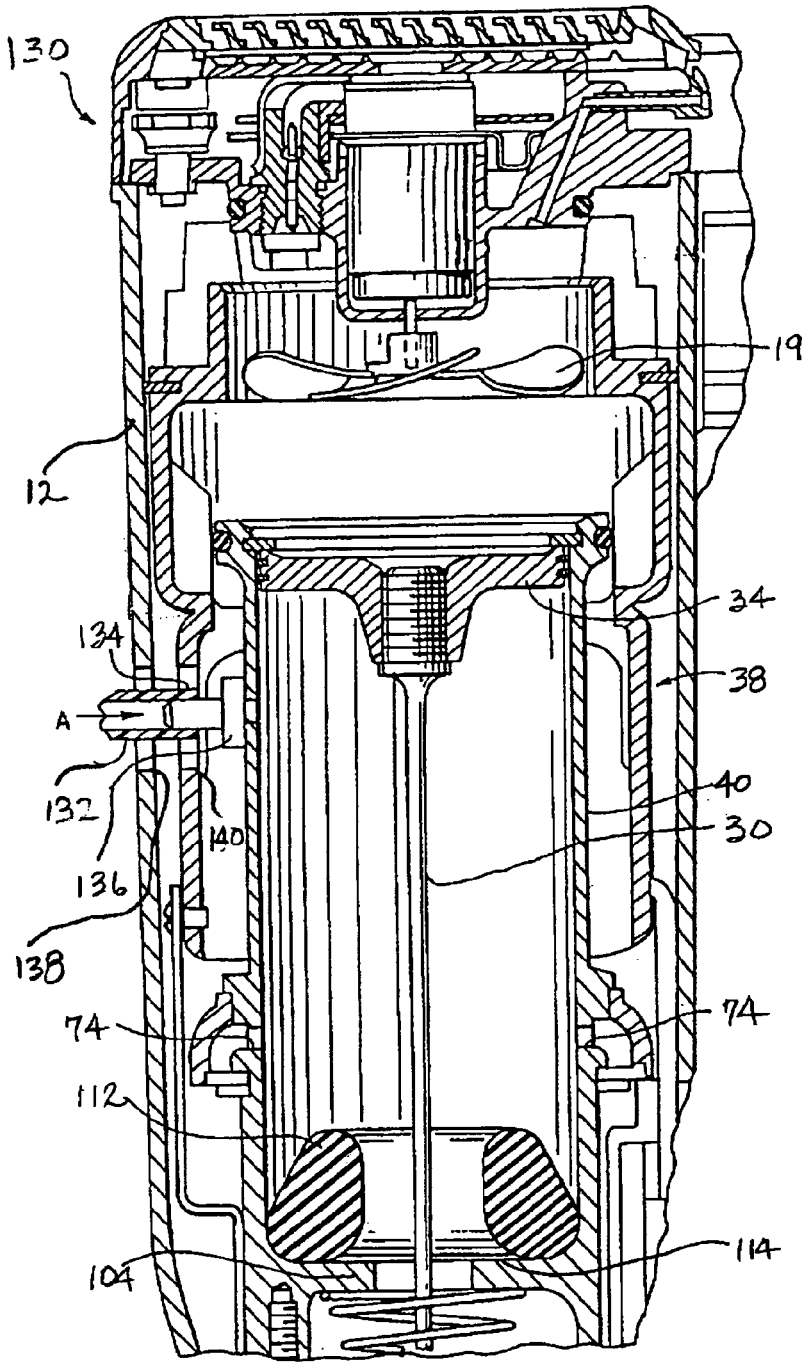
FIG.5 PRIOR ART
FIG. 5 is a fragmentary vertical section of a combustion-powered fastener-driving tool equipped with a prior art system for using exhaust gas for driving a magazine advance.

Referring now to FIG. 5, the prior system of U.S. Pat. No. 5,558,264 is illustrated. The tool, generally designated 130, incorporates many features of the tool 10; however some are earlier versions of those features. Nevertheless, the components representing similar features have been designated with like reference numbers for ease of explanation. The tool 130 is designed for being equipped with a coil magazine (not shown) and a magazine advancement mechanism represented by the cylinder 56 (FIG. 1). To power the advancement mechanism, a conduit 132 is connected between the cylinder 56 and the cylinder 40. The conduit 132 is located externally of the tool 130. An inlet end 134 of the conduit 132 is connected to a nipple fitting 136, which in turn is affixed to and in fluid communication with, the cylinder 40. Openings 138, 140 respectively in the tool housing 12 and the valve sleeve 38 accommodate passage of the conduit 132.

In operation, the conduit 132 diverts combusted gases from the cylinder 40 into the fastener feed advance cylinder 56 in a manner which advances the feed mechanism and advances a fastener to be driven by the driver blade 30. As stated above, the system disclosed in U.S. Pat. No. 5,558,264 has suffered from poor reliability when used in typical tool operational environments. In addition, the positioning of the conduit 132 relative to the combustion chamber 44 and the travel stroke of the piston 34 has been found to limit the amount of air flow to the fastener feed advance cylinder 56 and was a factor in reducing the reliability in the prior art fastener feed system.

While a particular embodiment of the present exhaust driven actuation feed tube for a combustion-powered fastener-driving tool has been described herein, it will be appreciated by those skilled in the art that changes and modifications may be made thereto without departing from the invention in its broader aspects and as set forth in the following claims.

The invention claimed is:

1. A combustion tool having a gas actuated magazine advance, comprising:

a combustion chamber defined in part by a cylinder, a valve sleeve axially reciprocating relative to the cylinder and an upper surface of a piston;

a pneumatically actuated magazine fastener advance mechanism; and an exhaust driven actuation feed tube having a first end configured for insertion into an opening in the cylinder in fluid communication with the combustion chamber and a second end connected to said magazine fastener advance mechanism.

2. The tool of claim 1 wherein said first end of said tube is connected to the combustion chamber above said upper surface of said piston.

3. The tool of claim 1 further including a housing and wherein said tube is located within said housing.

4. The tool of claim 1 wherein said first end of said tube is angled relative to a longitudinal tube axis.

5. The tool of claim 4 wherein said tube includes a sleeve portion axially adjacent said first end and configured for disposition between an exterior of the cylinder and an interior of the valve sleeve so that the valve sleeve freely reciprocates relative to the cylinder.

6. The tool of claim 5 further including an exhaust portion axially adjacent said sleeve portion and forming a general "C" shape around an exhaust valve of the tool.

7. The tool of claim 6 further including an actuation portion axially adjacent said exhaust portion and configured for fluid communication with the exhaust activated magazine fastener advance mechanism.

8. The tool of claim 7 wherein said actuation portion ends in a second end of said tube, at least one of said first and second ends being sealingly secured in said tool with a chemical adhesive.

9. The tool of claim 1 wherein said tube is disposed in said tool without the use of tools.

10. The tool of claim 1 wherein said tube is disposed in said tool free of at least one of nipple fittings, elbow fittings and threaded connectors.

11. The tool of claim 1 wherein said exhaust tube has a volume which is found in the approximate range of 0.25 to 1.05% of engine displacement.

12. A gas driven actuation tube for a combustion tool with a combustion chamber defined in part by a cylinder and a valve sleeve axially reciprocating relative to the cylinder, the combustion tool also provided with a pneumatically actuated magazine fastener advance mechanism, said tube comprising:

a first end being angled relative to a longitudinal axis and configured for insertion into an opening in the cylinder in fluid communication with the combustion chamber;

a sleeve portion axially adjacent said first end and configured for disposition between an exterior of the cylinder and an interior of the valve sleeve so that the valve sleeve freely reciprocates relative to the cylinder;

an exhaust portion axially adjacent said sleeve portion and forming a general "C" shape around an exhaust valve of the tool; and an actuation portion axially adjacent said exhaust portion and configured for fluid communication with the magazine fastener advance mechanism.

13. The tube of claim 12 wherein said tube is configured so that at least said first end, said sleeve portion and said exhaust portion are located within the tool.

14. The tube of claim 13 wherein said actuation portion is configured to be substantially located within the tool.

15. The tube of claim 12 further including a chemical sealant for sealingly securing at least said first end to the cylinder.

16. The tube of claim 12 wherein said tube is configured for being disposed and secured into the tool without tools.

17. The tube of claim 12 wherein said tube is configured for being disposed and secured into the tool without nipples, elbows or threaded connectors.

18. The tube of claim 12 wherein said first end is disposed at an approximate 10° angle relative to said sleeve portion.

19. The tube of claim 12 wherein said exhaust portion includes a main segment generally parallel with said sleeve portion and having two ends, each said end being radiused for providing a transition to said respective sleeve and actuation portions.

* * * * *